United States Patent [19]

Murthy et al.

[11] Patent Number: 4,543,177

[45] Date of Patent: Sep. 24, 1985

[54] PRODUCTION OF LIGHT HYDROCARBONS BY TREATMENT OF HEAVY HYDROCARBONS WITH WATER

[75] Inventors: Andiappan K. S. Murthy, Lake Hiawatha; Kundanbhai M. Patel, Landing; Alex Y. Bekker, Teaneck, all of N.J.

[73] Assignee: Allied Corporation, Morris Township, Morris County, N.J.

[21] Appl. No.: 619,663

[22] Filed: Jun. 11, 1984

[51] Int. Cl.[4] ..... C10G 29/02; C10G 35/02; C07C 4/04

[52] U.S. Cl. ..... 208/130; 585/652; 208/72

[58] Field of Search ..... 208/130; 585/652

[56] References Cited

U.S. PATENT DOCUMENTS

| | | | |
|---|---|---|---|
| 2,135,332 | 11/1938 | Gary | 208/130 |
| 2,309,540 | 1/1943 | Rollman et al. | 208/130 |
| 2,601,257 | 6/1952 | Buchan | 208/11 LE |
| 3,401,110 | 9/1968 | Floyd et al. | 208/11 LE |
| 3,989,618 | 11/1976 | McCollum et al. | 208/130 X |
| 4,264,431 | 4/1981 | Ishikawa et al. | 208/11 LE X |
| 4,446,012 | 5/1984 | Murthy et al. | 208/130 |

*Primary Examiner*—D. E. Gantz
*Assistant Examiner*—Glenn A. Caldarola
*Attorney, Agent, or Firm*—R. C. Stewart, II; A. M. Doernberg; G. H. Fuchs

[57] ABSTRACT

A process is disclosed for converting heavy hydrocarbons into light hydrocarbons which comprises contacting, in a first zone, a heavy hydrocarbon having an API gravity at 25° C. of less than about 20, such as Boscan heavy crude oil and tar sand bitumen, with a liquid comprising water, in the absence of externally added catalyst and hydrogen, while maintaining the first zone at a temperature between 400° and about 480° C. and at a pressure at least about 690 kPa (about 100 psig, about 6.76 atm) and less than about 5,000 kPa (about 725 psig, about 148 atm), for a contact time under continuous flow conditions sufficient to produce a uniform (i.e., intimate) reaction mixture; forwarding the uniform reaction mixture to a second zone wherein the temperature and pressure conditions of the first zone are maintained at substantially steady state conditions for a time sufficient to separate the uniform mixture into a residue and a phase comprising light hydrocarbons, gas and water, withdrawing the residue and said phase from the second zone; and recovering a light hydrocarbon product having an API gravity at 25° C. of greater than about 20 and substantially free of vanadium and nickel values, i.e., less than 50 ppm, preferably less than 10 or 5 ppm, a gaseous product, and a residue.

23 Claims, 3 Drawing Figures

PRODUCTION OF LIGHT HYDROCARBONS BY TREATMENT OF HEAVY HYDROCARBONS WITH WATER

DESCRIPTION

Background of the Invention

The present invention relates to a process for treating heavy hydrocarbons with water to form light hydrocarbons, a gaseous product and a residue. More particularly, the present invention is directed to a process for treating heavy hydrocarbons containing organometallics, for example vanadium and nickel, organosulfur and organonitrogen compounds, and asphaltenes with water at elevated temperatures and relatively low pressures, in the absence of externally added catalyst and hydrogen, at substantially steady rate for a time sufficient to form a light hydrocarbon product, substantially free of vanadium and nickel, a gaseous product and a residue. The residue can be further treated with water in a third zone to recover additional light hydrocarbon product.

There exist enormous quantities of heavy hydrocarbons such as heavy petroleum crude oils and tar sand bitumen (the heavy hydrocarbons extracted from tar sands), as well as residual heavy hydrocarbon fractions obtained from heavy hydrocarbon crudes such as atmospheric tower bottoms products, vacuum tower bottoms products, crude oil residuum and heavy vacuum gas oils. These heavy crude and residual hydrocarbon streams contain large amounts of organometallic compounds, especially those containing nickel and vanadium, organosulfur and organonitrogen compounds, and asphaltenes (high molecular weight polycyclic, pentane insoluble materials). In addition, these heavy crude and residual hydrocarbons are viscous and as such require a greater degree of processing to convert them into liquid materials that can be transported easily.

A number of alternate physical and chemical routes have been and are still being developed for converting heavy hydrocarbon materials into lighter liquid and gaseous fuels. Among the approaches are physical separation processes such as vacuum distillation, steam distillation, and solvent deasphalting, various thermal conversion processes such as visbreaking, delayed coking, fluid coking and coke gasification, catalytic processes such as hydrotreating, hydrorefining and hydrocracking, as well as multistage catalytic and non-catalytic processes. Each of these approaches has one or more drawbacks. In physical separation processes such as vacuum distillation, steam distillation and solvent deasphalting, a liquid hydrocarbon fraction is recovered in low yield but the asphaltene and resinous materials are not converted into product and must be disposed of separately. The various thermal conversion processes such as visbreaking, delayed coking, fluid coking and coke gasification require high temperatures above 500° C. and generate a low quality by-product coke. In coke gasification, treatment of heavy hydrocarbons with steam and oxygen at high temperatures is necessary to produce a product gas, which must be utilized locally, and a limited yield of lighter liquid hydrocarbon product. Recently, a thermal conversion process called the Eureka process was disclosed in Chemical Engineering Progress, February 1981, pages 37–44 and in U.S. Pat. No. 4,242,196. The Eureka process converts petroleum residues, such as mixtures of vacuum residues from Khafij crude oil, or Iranian heavy crude oil, into a low sulfur petroleum oil and petroleum pitch by preheating the mixture of vacuum residues to about 450° to 520° C., feeding the preheated mixture to a fractionator and then to a charge heater at 500° C. before stripping the thermally cracked low molecular weight hydrocarbons with superheated steam in a delayed coker reactor at 420°–430° C. under atmospheric pressure. Catalytic hydrogenation processes such as hydrotreating, hydrorefining, and hydrocracking may be used for converting heavy hydrocarbon feedstocks into a good quality material in high yield. However the hydrogenation catalyst employed in each of these processes is rapidly poisoned by the exceedingly large amounts of organometallic compounds and asphaltenic material in the heavy hydrocarbon feedstocks. The high levels of organometallic compounds in the feedstocks interfere considerably with the activity of the catalyst with respect to destructive removal of nitrogen and sulfur and oxygenated compounds such that the consumption of more than 3 kilograms of catalyst per 1000 kilograms of oil processed is normally required.

U.S. Pat. No. 4,264,431 (C. Ishikawa et al.) discloses a process for treatment of oil sand including the steps of (a) recovering a bitumen from said oil sand; (b) distilling said bitumen; (c) thermally cracking the residual oil obtained by distilling said bitumen by directly injecting a so-called "inert" heating medium, e.g., superheated steam at a temperature of 400° to 700° C. into said residual oil in a liquid state for 20 to 90 minutes while maintaining said residual oil at a temperature within the range of 350° to 450° C. during said injection thereby to obtain a crude synthetic oil, cracked gas and a highly combustible pitch; and (d) burning said highly combustible pitch to obtain thermal energy used for recovering said bitumen from said oil sand in step (a). The pressure of the thermal cracking (step (c)) is not specified. However, the only working example for the thermal cracking step (Example 1) discloses that the residual oil obtained by distilling the bitumen is made to react by flowing superheated steam from a small diameter pipe equipped with multiple nozzles and immersed into the residual oil in a reaction vessel provided with a stirrer, a heating device and a cooling device for the distillate. Thus, the thermally cracking step is apparently a distillation which operates at temperatures of 350°–450° but atmospheric pressure to effect separation and recovery of a distilled oil (whose properties are reported in Table 5 of the reference), a cracked gas and a highly combustible pitch which is burned to obtain thermal energy for recovering step (a). Moreover, the metal content of the distilled oil is not specified.

The prior art has also converted organic heavy hydrocarbons and other organic liquids to fuels by reaction with water. U.S. Pat. No. 4,113,446 (Modell et al.) discloses that liquid or solid organic materials can be converted into high BTU gas, with little or no formation of undesirable char or coke, when organic material is reacted with water at a temperature at or above the critical temperature of water and at or above the critical pressure of water to achieve the critical density of water. While U.S. Pat. No. 4,113,446 discloses that the process may be conducted either in the presence or absence of a catalyst, only gas and no liquid hydrocarbon fractions are recovered. International Publication No. WO 81/00855 (corresponding to U.S. patent application Ser. No. 079,534, filed Sept. 29, 1979 by M. Modell) discloses that organic solid or liquid material is admixed with water (in the region of the critical density of water, i.e., densities of water from 0.2 to 0.7 gms/cm$^3$) at pressures from 200–2500 atmospheres and at temperatures from 374° C. to at least about 450° C. to restructure the organic materials to form useful volatile organic liquids.

U.S. Pat. No. 3,983,027 (McCollum et al.) discloses a process for cracking, desulfurizing and demetallizing heavy hydrocarbon feedstocks such as vacuum gas oil, tar sand oils and atmospheric residual oils to produce gases, liquids (heavy ends and light ends), and a solid residue by contacting the heavy hydrocarbons with a dense-water containing fluid at a temperature in the range of 349° C. to 400° C. (660°–752° F.) and at a pressure in the range of 2500 psig to 4400 psig in the absence of an externally supplied catalyst and hydrogen or other reducing gas. The density of water in the dense-water containing fluid was at least about 0.1 g/mL, and sufficient water was present to serve as an effective solvent for recovered liquids and gases. However, in the examples which disclose a process for removal of vanadium and nickel, straight tar sands having no more than 256 ppm of vanadium and nickel were treated with water at 400° C. and 4100–4350 psig for at least one hour. To produce a hydrocarbon product having an API density of 21 and low (10 ppm) nickel and vanadium content, the presence of alundum balls in the reaction zone at 400° C. and 4100 psig and extremely low flow rates (1 mL of tar sands and oil per hour) were required. In another example run under identical conditions except that the flow rate was 2 mL/hour, the hydrocarbon product had an API density of 17.8 and an unacceptably higher (77 ppm) nickel and vanadium content.

U.S. Pat. No. 2,135,332 (Gary) discloses a process for the cracking of relatively heavy oil, such as reduced crude, other heavy oils of residual nature or a heavy gas oil consisting principally of constituents boiling above 700° F. to produce gases, liquids (lower boiling hydrocarbons of the gasoline range) and a solid or liquid residue including coke by admixing the heavy oil with a diluent such as steam, low boiling hydrocarbon gases or fixed gases at temperatures in the range of 650°–975° F. (343°–524° C.) and at pressures as low as 300 lbs/sq in, preferably in the neighborhood of 2,000–3,000 lbs/sq in. Gary discloses the admixture is treated in three coils in a furnace; the admixture is preheated to a temperature just below the cracking temperature, such as 650°–700° F. (343°–371° C.), followed by passing the preheated mixture to a zone wherein it is rapidly heated to a temperature in excess of 900° F. (>482° C.) followed by heating in another portion of the furnace at a temperature below the cracking temperature wherein the desired conversion is carried to completion. The converted products from the furnace are passed through a pressure letdown valve and forwarded thence to an evaporator where vapors separate from a residue which may be solid coke or liquid. In the evaporator the residue is separated from the vapors and the vapors are forwarded to a fractionation zone to separate out the higher boiling components and recover liquid boiling in the gasoline range. Further, Gary discloses that coke is formed within the heating coil by conversion of heavy asphaltenes and viscous materials due to the higher temperature and prolonged heating within the heating zone, but that less coking difficulties are encountered within the heating coil when operating under his high temperature (>480° C.) and high pressure (2000–3000 psi) conditions than are encountered under low temperature, low pressure conditions. However, Gary does not suggest a method of converting heavy oil containing high metal values, e.g., nickel and vanadium, into a light hydrocarbon oil substantially free of such metal values.

U.S. Pat. No. 4,446,012, issued May 1, 1984 to the present inventors, discloses a process for converting heavy hydrocarbons into light hydrocarbons which comprises contacting, in a first zone, a heavy hydrocarbon having an API gravity at 25° C. of less than about 20, such as Boscan heavy crude oil and tar sand bitumen, with a liquid comprising water, in the absence of externally added catalyst and hydrogen, while maintaining the first zone at a temperature between about 380° and about 480° C. and at a pressure between about 5,000 kPa (about 725 psig, about 49 atm) and less than about 15,000 kPa (about 2,175 psig, about 148 atm), for a time sufficient to produce a uniform reaction mixture; forwarding the uniform reaction mixture to a second zone wherein the temperature and pressure conditions of the first zone are maintained for a time sufficient to separate the uniform mixture into a residue and a phase comprising light hydrocarbons, gas and water, withdrawing the residue and said phase from the second zone; and recovering a light hydrocarbon product having an API gravity at 25° C. of greater than about 20 and substantially free of vanadium and nickel values, i.e., less than 50 ppm, preferably less than 30 ppm, a gaseous product, and a residue.

In addition, there are various catalytic processes for treating heavy hydrocarbons with water with specific externally supplied catalyst systems and externally supplied hydrogen at specified temperatures above the critical temperature of water and at specified pressures, from below to above the critical pressure of water.

SUMMARY OF THE INVENTION

It has been discovered that heavy hydrocarbons feedstocks containing vanadium and nickel values, may be converted into light hydrocarbon products substantially free of vanadium and nickel values by contacting the heavy hydrocarbon feedstocks with water, in the absence of externally added catalyst and hydrogen, at selected pressure and temperature ranges. A lower pressure range than previously thought possible was selected, depending upon the heavy hydrocarbon feedstock, to produce a light hydrocarbon product substantially free of vanadium and nickel values; thereafter, temperature range was selected to provide a sufficient quantity of light hydrocarbon product at acceptable reaction rates while avoiding coke formation. Accordingly, the present invention provides a process for converting heavy hydrocarbons into light hydrocarbons which comprises:

(a) contacting, in a first zone, heavy hydrocarbons having an API gravity at 25° C. of less than about 20 with a liquid comprising water (in actual practice a fluid with water in both liquid and vapor phases), in the absence of externally added catalyst and hydrogen, at a temperature between about 400° C.–480° C. and at a pressure between about 690 kPa (about 100 psig, about 6.76 atm) and less than about 5,000 kPa (about 725 psig, about 49 atm), and for a contact time under continuous flow conditions sufficient to form a uniform (i.e., intimate) mixture;

(b) forwarding the uniform mixture to a second zone while maintaining the temperature and pressure conditions of the first zone;

(c) maintaining the uniform mixture in the second zone at substantially steady state under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone (the residue optionally to be treated in a third zone);

(e) separating said phase into a gaseous product, a liquid comprising water, and light hydrocarbon product having an API gravity at 25° C. of greater than about 20 and substantially free of vanadium and nickel values; and (f) recovering said light hydrocarbon product.

The present invention also provides a process for converting heavy hydrocarbons into light hydrocarbons which comprises:

(a) contacting, in a first zone, heavy hydrocarbons having an API gravity at 25° C. of less than about 20 and a total vanadium and nickel content between about 1000 and 2000 ppm with a liquid comprising water, in the absence of externally added catalyst and hydrogen, at a temperature between about 400° C. and about 480° C., and at a pressure between about 690 kPa (about 100 psig, about 6.76 atm) and less than about 5,000 kPa (about 725 psig, about 49 atm) for a contact time under continuous flow conditions sufficient to form a uniform mixture;

(b) forwarding the uniform mixture to a second zone while maintaining the temperature and pressure conditions of the first zone;

(c) maintaining the uniform mixture in the second zone at substantially steady state under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and light hydrocarbon product having an API gravity at 25° C. of between about 20 and 40 and substantially free of vanadium and nickel values; and (f) recovering said light hydrocarbon product.

The present invention still further provides a process for converting heavy hydrocarbons into light hydrocarbons which comprises:

(a) contacting, in a first zone, heavy hydrocarbons having an API gravity at 25° C. of less than about 20 and a total vanadium and nickel content of between about 100 and 1000 ppm with a liquid comprising water, in the absence of externally added catalyst and hydrogen, at a temperature between about 400° and 480° C. and at a pressure between about 690 kPa (about 100 psig, about 6.76 atm) and less than about 5,000 kPa (about 725 psig, about 49 atm) for a contact time under continuous flow conditions sufficient to form a uniform mixture;

(b) forwarding the uniform mixture to a second zone while maintaining the temperature and pressure conditions of the first zone;

(c) maintaining the uniform mixture in the second zone at substantially steady state under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and light hydrocarbon product having an API gravity at 25° C. of between about 20 and 40 and substantially free of vanadium and nickel values; and (f) recovering said light hydrocarbon product.

In each of these three forms, the residue withdrawn in step (d) may be further treated with water to recover additional light hydrocarbon products.

DETAILED DESCRIPTION OF THE INVENTION AND OF THE PREFERRED EMBODIMENTS

Figure 1:
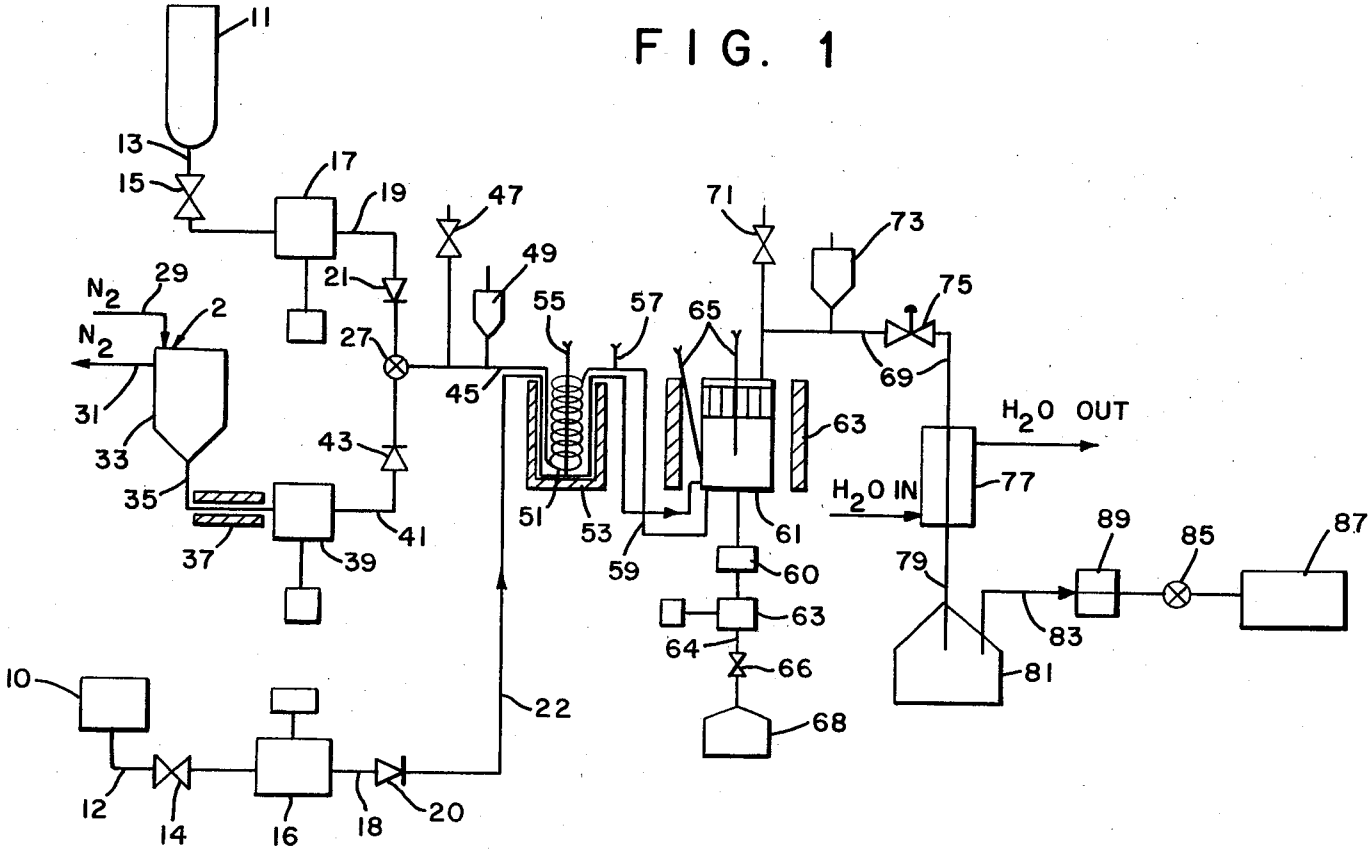
FIG. 1 is a schematic of a preferred embodiment of the process of the present invention operated in a flow reactor.

In accordance with the present invention, heavy hydrocarbons having an API gravity at 25° C. of less than about 20 are treated with water under continuous, steady state conditions at elevated temperature and relatively mild pressures (compared to the higher pressure conditions disclosed in U.S. Pat. No. 4,446,012) in the absence of externally added catalyst and/or hydrogen to produce a light hydrocarbon product having an API gravity at 25° C. of greater than about 20 and substantially free of vanadium and nickel values. The light hydrocarbon product is substantially free of vanadium and nickel values as disclosed below, and as such can be catalytically reformed, at low catalyst consumption rates, into kerosene, diesel oil and gasoline, compared to heavy hydrocarbon feedstocks. By the term "substantially free of vanadium and nickel values" is meant a light hydrocarbon product containing generally less than about 50 ppm of combined vanadium and nickel values, preferably less than 10 ppm and more preferably less than 5 ppm, and as such suitable for catalytic reforming, at low catalyst consumption rates, compared to heavy hydrocarbon feedstocks. Surprisingly, we have discovered that by treating heavy hydrocarbon feedstocks with water *under steady state conditions* at temperatures between about 400° and about 480° C. and at a pressure between about 690 kPa and less than about 5,000 kPa, we obtain a light hydrocarbon product with total vanadium and nickel content usually less than 5 ppm, e.g., 1–2 ppm.

Whereas the process disclosed in our U.S. Pat. No. 4,446,012 may be operated in a semicontinuous (batch) mode under non-steady state conditions or in a continuous mode under steady state conditions to produce light hydrocarbon product substantially free of vanadium and nickel values, the process of the present invention is limited to a continuous mode of operation under substantially steady state conditions. By "substantially steady state conditions" we mean the period during operation in which temperature, pressure and flow rate are substantially constant over time. In general, temperature remains within 5° C. of mean, pressure within 15 psi (103 kPa) of mean and flow rate within 5% of mean values. In addition, the light hydrocarbon product has a lower specific gravity (API gravity at 25° C. greater than about 20), a lower viscosity and is usually substantially free of nitrogen and usually contains only about 75% of the sulfur contained in the heavy hydrocarbon starting material. It is a special feature of the present invention, that crude heavy hydrocarbons may be used as feedstocks in the process of the present invention without pretreatment, e.g., distillation such as was practiced in the prior art, e.g., U.S. Pat. No. 4,264,431. Thus, Boscan heavy oil—heavy petroleum crude oil from the Venezuelan Orinoco heavy oil belt—was treated with water at a temperature of 435° C. and at a pressure of 1725 kPa (250 psig) in accordance with a preferred embodiment of the present invention to produce about 73 weight % of light hydrocarbon product of API gravity of about 27.3 (25° C.), a viscosity of about 10.7 (25° C.) cp and containing about 3.0 ppm of vanadium and nickel values, about 24 weight percent of residue and about 3 weight percent of gaseous products. In another preferred embodiment of the present invention, tar sand bitumen, isolated from Alberta Athabasca tar sand by hot water extraction (but no distillation) was treated directly with water at a temperature of 435° C. and at pressure of 1725 kPa (250 psig) to produce about 70.70 weight percent of light hydrocarbon products of API gravity of 25.2 (at 25° C.), a viscosity of 13.4 (at 25° C.) and containing less than about 4.0 ppm of vanadium and nickel valves, about 27.78 weight percent of residue and about 1.52 weight percent of gaseous products. Thus, the process of the present invention operates with a wide range of heavy hydrocarbon feedstocks, i.e., the whole barrel of crude hydrocarbons as well as the "bottom of the barrel" (vacuum reside). A residue is formed that is usually soluble in the heavy hydrocarbon starting material and that contains no coke which would interfere with the operation of the present invention. All of these advantages are achieved by the process of the present invention in the absence of externally added catalyst and/or hydrogen.

The temperature of the first and second zones (and if used, third zone) is between about 400° and about 480° C., preferably between about 420° and about 470° C. and more preferably between about 435° and 460° C. The pressure of the first and second zones (and, if used, third zone) is at least about 690 kPa (about 100 psig, about 6.76 atm) and less than about 5,000 kPa (about 725 psig, about 49 atm), preferably at least about 1725 kPa (about 250 psig, about 16.9 atm) and less than about 5,000 kPa (about 725 psig, about 49 atm) and more preferably between about 1725 kPa (about 250 psig, about 16.9 atm) and 3450 kPa (about 500 psig, about 33.8 atm).

In a preferred embodiment of the present invention, a pressure of about 1725 kPa (250 psig) and a temperature range of about 435°-460° C. are used. In another preferred embodiment of the present invention, a pressure of about 3450 kPa (500 psig) and a temperature of about 420°-440° C. are used.

It is a feature of the present invention that the range of temperature and pressure recited hereinabove is maintained in both the first and second zones and, if used, the third zone. In the first zone the heavy hydrocarbons are contacted with a liquid comprising water under temperature and pressure conditions and for a time sufficient to form a uniform mixture. The uniform mixture is forwarded to a second zone while maintaining the temperature and pressure conditions of the first zone. In the second zone the uniform mixture is maintained under temperature and pressure conditions of the first zone for a time sufficient to separate the uniform mixture into a residue and a phase comprising light hydrocarbons, gas and water. It is a special feature of the present invention that the separation step is effected while maintaining the temperature and pressure conditions of the first zone in the second zone. The residue and the phase in the form of vapors comprising light hydrocarbons, gas and water are withdrawn from the second zone at the temperature and pressure of the first zone.

In many preferred embodiments of the invention, the residue withdrawn from the second zone is transferred to a third zone operated at substantially the same temperature and pressure and contacted there with steam. The liquid and vapor thereby produced may be worked up separately or combined in various fashions with the phase of vapors also removed from the second zone.

In a preferred embodiment of the present invention, the phase comprising the vapor phase withdrawn from the second zone (and, if used, the third zone) is separated into a gaseous product, a liquid comprising water and light hydrocarbon products, and the liquid hydrocarbon product is recovered. In another preferred embodiment of the present invention, the separation of the vapor phase into its components is effected by reducing the pressure and temperature of the second zone to values sufficient to allow phase separation. In another preferred embodiment of the present invention, the phase separation is effected at the temperature and pressure values maintained in the second zone (and, if used, third zone) and only after the liquid hydrocarbons are removed from the gas and the liquid comprising water is the pressure and temperature reduced to ambient values. In another preferred embodiment of the present invention illustrated in FIG. 3, the temperature of the vapor phase is lowered in a quench tower to a value below about 350° C. so as to minimize formation of additional residue. Any condensate which may be recovered from the vapor phase as a result of the temperature lowering may be conveniently returned to the second zone and the remainder of the vapor phase may be forwarded for phase separation.

By the term "uniform mixture" as used herein, is meant an emulsion, or a solution of vapors in liquid or of vapors in vapor or liquid in liquid or any mixture thereof sufficient to provide intimate contacting so as to facilitate conversion of the heavy hydrocarbons into light hydrocarbon product.

By the term "phase" as used herein to describe the fluid phase comprising the liquid hydrocarbons, gas and water that are formed and removed from the second zone, is meant a mixture of vapor and liquid or vapor, gas and liquid or all vapors.

By the term "residue" we mean the solid material withdrawn from the second zone together with a fluid adhering thereto. Residue remaining after further treatment in a third (or subsequent) zone is called "unconverted residue" or "second residue".

The water to oil volume ratio may be varied from about 1:4 to about 10:1, preferably about 1:1 to about 3:1 and more preferably about 1:1.

The process of the present invention operates in the absence of externally added catalyst and/or hydrogen; only the hydrogen provided from the water in the absence of externally added catalyst is required for the process of the present invention. By analogy to deuterium labelling experiments with Boscan heavy oil conducted under conditions disclosed in commonly-assigned U.S. Pat. No. 4,446,012, it is believed that water is a reactant and not merely a solvent in the process of the present invention. In some instances it may be desirable to provide the first and/or second zones with a packed bed of inert materials such as particles of granite, sand, porcelain or bed saddles. The use of inert materials in first and/or second zones is not critical to operation of the present invention. In addition, corrosion inhibitors such as sodium carbonate may be added with the water if chlorides or other potentially corroding ions are present in the water used. In addition, it is preferable to operate the process of the present invention in an atmosphere substantially free of gases such as oxygen which may interfere with the process of the present invention. However, the presence of small amounts of air are not detrimental to the process of the present invention.

The process of the present invention operates with heavy hydrocarbons having an API gravity at 25° C. of less than about 20. Among the heavy hydrocarbons found useful in the process of the present invention are heavy crude oil, heavy hydrocarbons extracted from tar sands, commonly called tar sand bitumen, such as Cold Lake bitumen or Athabasca tar sand bitumen obtained from Canada, heavy petroleum crude oils including but not limited to Venezuelan Orinoco heavy oil belt crudes (Boscan heavy oil), as well as heavy hydrocarbon fractions obtained from crude petroleum oils particularly heavy vacuum gas oils, vacuum residue as well as petroleum tar and coal tar. The viscosity measured at 25° C. of the heavy hydrocarbon feedstock material may vary over a wide range from about 1,000 to about 100,000 cp, normally 20,000 cp to about 65,000 cp. In a preferred embodiment of the present invention Boscan heavy oil having a viscosity of about 60,000 cp at 25° C. were treated with water at a temperature of 450° C. and at pressures of about 1725 and 3450 kPa (250 and 500 psig, respectively) to produce a light hydrocarbon product having a viscosity at 25° C. less than about 11 cp. In another preferred embodiment of the present invention tar sand bitumen having a viscosity of about 72,500 cp at 25° C. was converted by treatment with water at a temperature of 435° C. and at pressures of about 1725 and 3450 to kPa (250 and 500 psig, respectively) into light hydrocarbon product having a viscosity at 25° C. less than about 15 cp. Among the organometallic compounds found in the heavy hydrocarbons, nickel and vanadium are most common although other metals including iron, copper, lead and zinc are also often present. In a preferred embodiment of the process of the present invention heavy hydrocarbons having an API gravity at 25° C. of less than about 20 and a total vanadium and nickel content between 1,000 and 2,000 ppm was converted into light hydrocarbons having an API gravity of 25° C. of between about 20 and 40 and a total vanadium and nickel content less than about 50 preferably less than about 30 ppm. In another preferred embodiment of the present invention heavy hydrocarbons having an API gravity at 25° of less than about 20 and a total vanadium and nickel content of between about 100 and 1000 ppm were converted into light hydrocarbon product having a API density at 25° between about 20 and 40 and a total vanadium and nickel content less than about 50 ppm preferably less than about 30 ppm.

FIG. 1 of U.S. Pat. No. 4,446,012 graphically illustrated that the vanadium and nickel concentration in the light hydrocarbon feedstock Boscan heavy oil with water in a semi-continuous reactor at 410° C. was minimized when the pressure was maintained in the range of about 9,000 kPa to 13,000 kPa (1305 psig to 1885 psig); the vanadium and nickel concentration in the light hydrocarbon product produced in a semi-continuous (batch) reactor at 410° C. at pressures higher than e.g. above about 15,000 kPa and lower than for example about 3,450 kPa increased dramatically. We stated in U.S. Pat. No. 4,446,012 that the results illustrated in FIG. 1 and obtained by treatment of Boscan heavy oil with water in a semi-continuous reactor at 410° C. under varying pressure conditions should be similar if Boscan heavy oil or tar sand bitumen would be treated with water in flow reactor similar to that illustrated in instant FIG. 1. Surprisingly, we have now discovered that the vanadium and nickel concentration of the light hydrocarbon product obtained by treatment of Boscan heavy oil or Athabasca tar sand bitumen with water in a continuous flow reactor at temperatures of 400°–480° C. and pressures of 690 kPa to 5,000 kPa was lower than that obtained by treatment of Boscan heavy oil with water at 410° C. in the semi-continuous (batch) reactor of U.S. Pat. No. 4,446,012. We now believe the vanadium and nickel concentration of a light hydrocarbon product obtained by treatment of Boscan heavy oil or tar sand bitumen with water in the continuous unit operated under steady state conditions instantly disclosed in FIG. 1 and General Experimental operated under the temperature and pressure range disclosed in U.S. Pat. No. 4,446,012 would be lower than that obtained by operation in the semi-continuous reactor of U.S. Pat. No. 4,446,012.

By the term "light hydrocarbon product" as used herein is meant a hydrocarbon having an API gravity at 25° C. of greater than about 20 preferably between about 20 and about 40. The light hydrocarbon product obtained in accordance with the process of the present invention has a total vanadium and nickel content generally of less than about 50 ppm, preferably less than about 10 ppm (total vanadium and nickel content of less than 5 ppm are usually observed; see for example Tables IIb and IVa) and is usually substantially free of organonitrogen compounds and usually contains only about 60% of the organosulfur compounds present in the starting heavy hydrocarbons. The viscosity of the light hydrocarbon product at 25° C. is less than about 25 cp, preferably less than about 10 cp. The hydrocarbon to carbon ratio of the light hydrocarbon is higher than the hydrogen to carbon ratio of the heavy hydrocarbons. In a preferred embodiment of the present invention, the heavy hydrocarbon, Boscan heavy oil having a hydrogen-carbon ratio equal to about 1.51 was treated with water at 450° C. and at pressures of 1725 and 3450 kPa (250 and 500 psig to produce light hydrocarbon products having a hydrogen-carbon ratios of about 1.64 and 1.62, respectively.

The gaseous product obtained by treatment of the heavy hydrocarbons in accordance with the process of the present invention comprises carbon dioxide, hydrogen sulfide and $C_1$–$C_6$ alkenes and alkanes as well as a trace amount of hydrogen and carbon monoxide. The amount of the gaseous product obtained is normally no more than 10 weight percent, preferably no more than about 5 weight %, and more preferably is less than about 3 weight %, basis starting heavy hydrocarbons.

The residue obtained by treatment of the heavy hydrocarbons in accordance with the process of the present invention is usually soluble in the feedstock heavy hydrocarbons. This residue is not a coke or pitch and as such may be used as a source of fuel, may be recycled or may be treated with steam or lower hydrocarbons such as pentane to remove light hydrocarbons that may be entrapped therein. Preferably, the residue is further treated in the third zone; and then the remaining residue is used, if at all, as a source of fuel.

The fluid comprising water may be tap water, river water, lake water or the like and may contain small amounts of salts accompanying the crude oil as obtained from the ground. While the presence of salt in the water may be tolerated, a salt concentration of greater than about 100 ppm is objectionable and is to be avoided. If chloride is present, sodium carbonate or sodium hydroxide is preferably added in amounts sufficient to neutralized any HCl generated.

The process of the present invention may only be carried out as a continuous process under steady state conditions. In the continuous process both the heavy hydrocarbons and water are fed under pressure to a preheated first zone wherein the temperature and pressure conditions are maintained for a time sufficient to form a uniform mixture which is forwarded to the second zone wherein the temperature and pressure conditions of the first zone are maintained for a time sufficient to separate the uniform mixture into a residue and a phase containing the light hydrocarbon and gaseous products; the phase is continuously removed from the second zone while the residue stream is continuously or periodically removed from the second zone. The residence time in the first and second zones may be varied from a few minutes up to about 20 minutes, depending upon characteristics of heavy hydrocarbon feedstock and light hydrocarbon product desired. In the batch process a total residence time of about 10–20 minutes, preferably about 10 minutes, is used. In the continuous process, a total residence time of a few minutes to 20 minutes, preferably about 1 minute to less than about 3 minutes is used. In a continuous process, less gas is obtained than in the semi-continuous or batch process; less than about 10 weight %, preferably less than about 5 weight % and usually less than about 3 weight % of the total products are produced as gas in the continuous process.

A preferred embodiment of the reaction of the present invention practiced in a continuous flow reactor is illustrated in FIG. 1. Water in first storage vessel 11 is passed via line 13 through valve 15 to high pressure piston pump 17 through line 19 containing check valve 21 to valve 27. Storage vessel 33 equipped with heating jacket 3 and heavy hydrocarbon feed line 2 pressurized with nitrogen via line 29 and a safety valve in line 31 is passed via line 35 equipped with heating tape 37 to high pressure gear pump 39 and then through line 41 check valve 43 to valve 27. In order to promote intimate contact between the heavy hydrocarbon and the water, the water from line 19 and the heated heavy hydrocarbon from line 41 are continuously fed through valve 27 into line 45 which may be equipped with a spiral stirrer to produce small droplets on the order of submicrons to about several microns of heavy hydrocarbon in the water. The intimate mixture in line 45 equipped with safety valve 47 and pressure transducer 49 is continuously fed to a spiral or tubular heater 51 immersed in the fluidized sand bath 53 equipped with thermocouple 55. The residence time in the heater 51 is preferably less than about 1 minute, more preferably on the order of about 10 seconds. The intimate heated uniform mixture of heavy hydrocarbon and water is passed via line 59 containing thermocouple 57 to high pressure autoclave 61 equipped with heating jacket 63, thermocouples of 65, gear block 60 and safety valve 71. Water in a second storage vessel 10 is passed via line 12 through valve 14 to high pressure piston pump 16 through line 18 containing check valve 20 to line 22. Line 22 is passed through heater 51 to bottom of the high pressure autoclave 61. Lines 41, 45 and 59 are equipped with heating tapes (not shown). The use of a single water storage vessel having volume equal to the combined volumes of the first and second storage vessels are considered within scope of the present invention. The residence time in the high pressure autoclave is from a few seconds up to about 20 minutes. The light hydrocarbon stream and the gaseous stream produced from the intimate contact in high pressure autoclave 61 are continuously removed via line 69 containing pressure transducer 73, air operated pressure control valve 75 to condenser 77 which may be of any convenient design. From condenser 77, the light hydrocarbon and the gaseous streams are passed via line 79 to product receiver 81 for separation of the light hydrocarbon stream from the gaseous stream. The gaseous stream is removed via line 83 passed through two dry ice condensers 84 and through volumetric flowmeter 85 to gas storage container 87. Residue is periodically removed via heated line 64 containing gear pump 63 and valve 66 to residue container 68.

It is a special feature of the process of the present invention that, in the second zone, the residue is separated from the vapor phase comprising light hydrocarbons, gas, and water while maintaining the pressure and temperature conditions of the first zone; the residue and vapor phase are withdrawn from the second zone and thereafter the pressure and temperature were reduced to values sufficient to allow recovery of the residue and separation of the vapor phase into a gaseous product, a liquid comprising water and a light hydrocarbon product having the desired properties.

By maintaining the pressure and temperature conditions of the first zone and the second zone for a time sufficient to effect separation and withdrawal of the residue and vaporous mixture, the residue is obtained substantially free of coke which would interfere with operation of the process of the present invention. In Comparative Example 4, Boscan heavy oil was continuously treated with water at 465°–470° C. and 2000 psig in a heating coil similar to that of U.S. Pat. No. 2,135,332 at varying residence times and the pressure and temperature reduced to ambient to form a reaction mixture which was thereafter distilled under vacuum to recover light hydrocarbon product. However, when the residence time was increased to provide greater than 50% up to 76% by weight of light hydrocarbons product, the heating coil became plugged with coke and the reaction was terminated.

Figure 2:
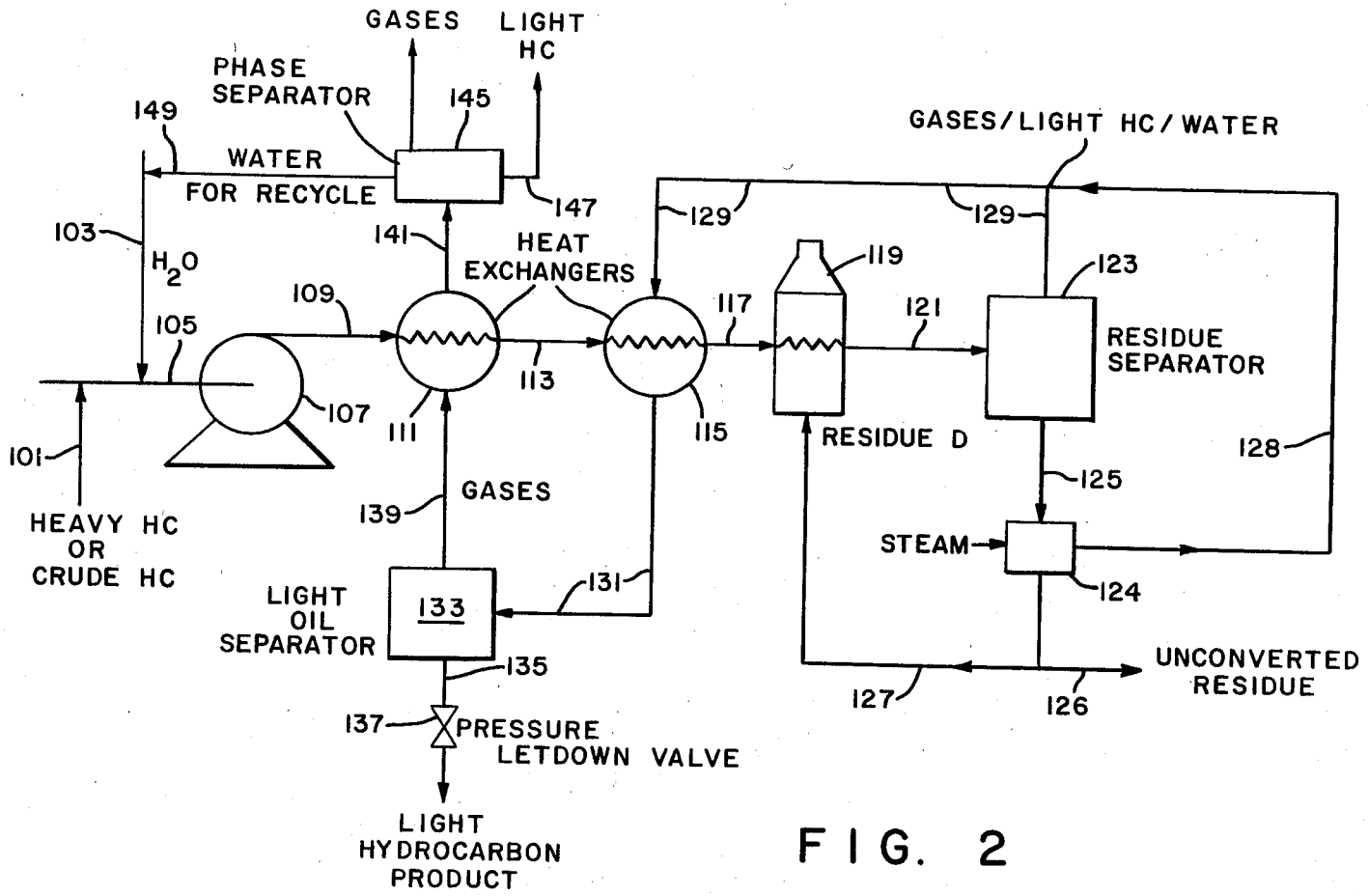
FIG. 2 is a schematic of another preferred embodiment of the process of the present invention operated in a flow reactor.

FIG. 2 illustrates a schematic of a flow reactor for continuous operation of another preferred embodiment of the present invention. A heavy hydrocarbon feedstock, such as heavy crude oil in line 101 is premixed with water in line 103 and the mixture is fed via line 105 to pump 107 which pumps mixture via lines 109 and 113 to high pressure heat exchangers 111 and 115 which may be of any convenient design and then via line 117 to high temperature preheater 119 which may conveniently be a high pressure direct-fired tubular heater. The reaction mixture from preheater 119 is passed via line 121 to residue separation unit 123. In separation unit 123, the reaction mixture is separated into a vapor stream 129 suitable for further processing and/or transportation, and containing (1) $C_1$–$C_6$ alkanes and alkenes, hydrogen sulfide, carbon dioxide and trace amounts of hydrogen, (2) light hydrocarbons, and (3) water vapor, and a residue stream 125.

The residue stream 125 is fed to a third zone 124 operated at substantially the same temperature and pressure conditions as the first zone (elements 117, 119 and 121) and second zone (residue operation unit 123). Steam is fed to the third zone to strip off of the residue adhering fluids and further convert solids into fluid materials (without generating high sulfur or metal values in the fluid phase). Third zone 124 may be operated continuously or in a batch fashion, but is preferably operated continuously under substantially steady state conditions.

The fluid formed in third zone 124 is removed therefrom in stream 128 and combined with gaseous stream 129 for further treatment as described below. The remaining residue after treatment in the third zone is removed from the third zone 124 and either removed from the process in stream 126 (for use as fuel elsewhere) or taken in stream 127 to preheater 119 and burned to heat the materials in preheater 119. The remaining residue may be split among these two uses as illustrated in FIG. 2, based upon the heating requirements of preheater 119 as a fraction of the heat value of the remaining residue.

The gaseous stream 129 (including the contents of stream 128) is passed through heat exchanger 115 in line 131 to light oil separator 133 wherein the light oil is removed via line 135 containing pressure let-down valve 137. The pressure let-down valve 137 may also be positioned in line 131. The gaseous alkanes, alkenes, carbon dioxide, hydrogen and water vapor removed from light oil in separator 133 via line 139 passes through heat exchanger 111 and line 141 to phase separator 143. Gases are removed from 143 via line 145. Light oil which may be present is removed via line 147. Water removed from phase separator 143 via line 149 is forwarded to water make-up line 103. The design of the separation units 123, 133 and 143 will depend on the type of heavy hydrocarbon feedstock used, the degree of restructuring desired, and other economic factors.

Figure 3:
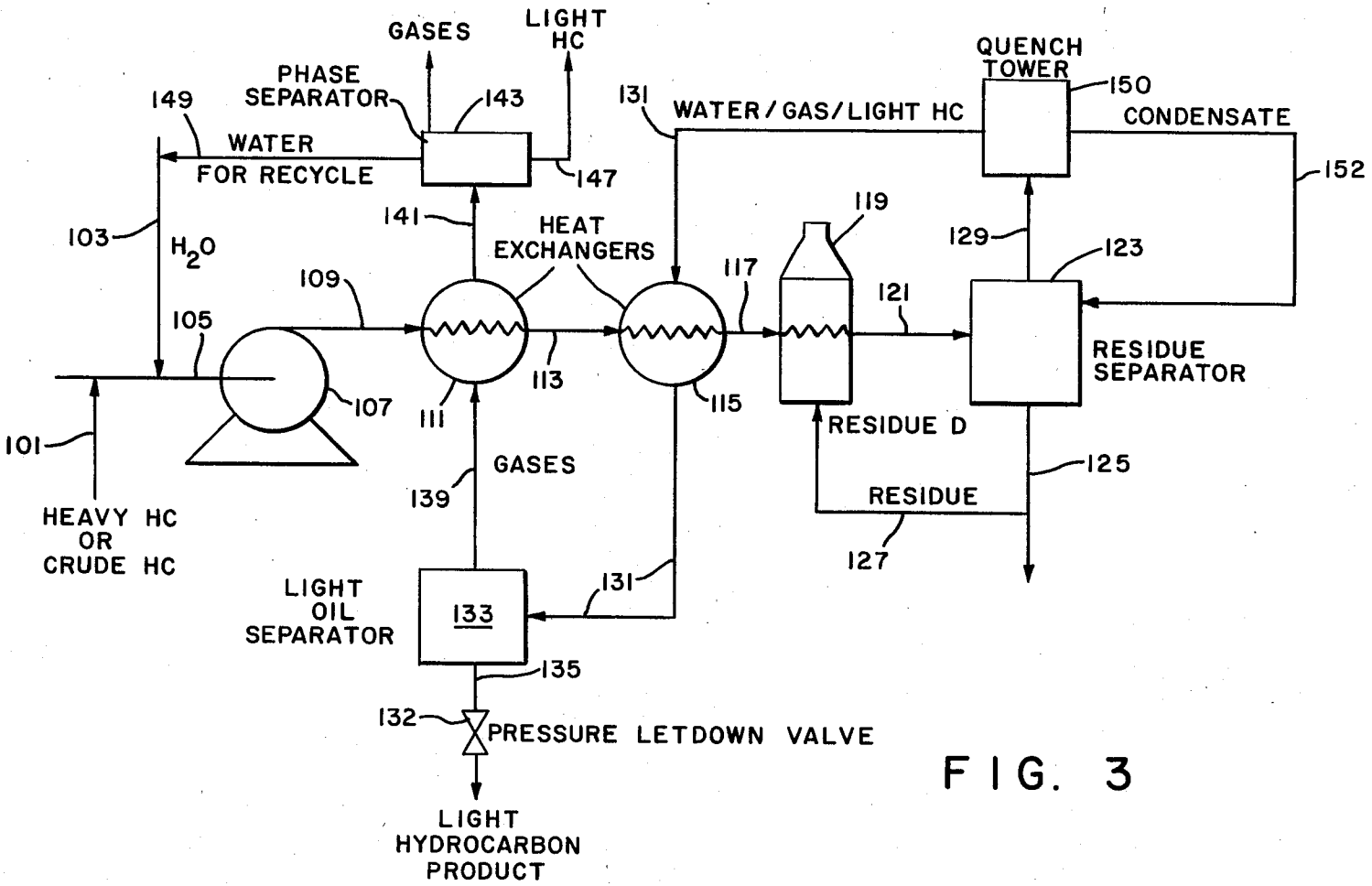
FIG. 3 is a schematic of still another preferred embodiment of the process of the present invention operated in a flow reactor.

FIG. 3 illustrates a schematic of a flow reactor for continuous operation of still another preferred embodiment of the present invention exactly analogous to the schematic of the flow reactor illustrated in FIG. 2 except that a quench tower 150 is positioned in line 129 containing gaseous stream from residue separator 123. The quench tower 150, which may be of any convenient design rapidly cools the gaseous stream to an approximate temperature of 350° C. so as to minimize formation of additional residue. A condensate stream 152, which may be formed in quench tower 150, may be conveniently returned to residue separation 123 and a gaseous stream 131 containing water vapor, light hydrocarbon (uncondensed) and gases may be forwarded to light oil separator 133. The presence of heat exchanger 115 in line 131 is optional. The residue of stream 125 may be further treated as in third zone 124 of FIG. 2.

The first and second zones for operating the process of the present invention may be separate reactors or two reaction zones within the same reactor. The reaction conditions, e.g., temperature and pressure, water:oil ratios chosen will, of course, depend on many considerations such as the heavy hydrocarbon feedstock available and the light hydrocarbon product desired.

The following examples illustrate the present invention and are not intended to limit the same.

GENERAL EXPERIMENTAL

Description—Continuous Flow Reactor.

A continuous flow reactor similar to that illustrated in FIG. 1 was used. Water and heavy crude oil were stored and fed separately from two graduated cylinders and low pressure storage vessels, respectively. Piston pumps (Bran and Lube and LDC-Milton Roy) were used for water. A high pressure gear pump (Zenith) was used for heavy crude oil. A constant pressure of nitrogen or argon was maintained in the storage vessel to ensure stable flow. The rate of pumping was controlled from an instrumentation panel. To reduce viscosity of the heavy oil, lines between the low pressure storage vessel and the storage-gear pump were heated to 80° C. The oil-water mixture and water were rapidly heated in a fluidized sand bath, and were introduced into a high pressure autoclave having a 300 mL volume. An automatic close loop control system was used to maintain the pressure. The pressure signal, measured by a pressure transducer (Gentron) was sent (through signal conditioner) into the controller (Eurotherm 917). The corrected output signal was transformed to a pneumatic action (Fairchild I/P inverter) which regulated the orifice size of an air-operated pressure control valve (Research Control).

The gaseous mixture of steam and light hydrocarbons was passed through a series of condensers and collected in a receiver. The uncondensed light hydrocarbon and gases were passed through two dry ice traps and into a buffer container, suitable for gas sampling and the gases were collected in a collapsible balloon. The solid residue removal system consisting of a mounting block at the bottom of the reactor and a high pressure gear pump, was heated bv band heaters and controlled from the instrumentation panel. The residue line was equipped with a high pressure ball valve (Skinner Engine Company) to ensure safe operation. The ball valve was controlled from the instrumentation panel. The complete unit was placed in an explosion-proof high pressure laboratory cubicile and was operated from the outside.

Analysis of Light Hydrocarbons, Gases and Residue.

The graphite furnace method was used to determine the amount of vanadium and nickel values in the light hydrocarbon stream, and atomic absorption method used for the residue. Viscosity was recorded either by New Metric or Cannon Ubhelode instrument. Density measurement was made by a pyconometer. $^1H$ and $^{13}C$ nmr spectra were recorded in deuterochloroform. For $^1H$ nmr Varian XL200 and for $^{13}C$ nmr Varian FT 80A instruments were used. Tris(acetonylacetyl)chromium [$Cr(acac)_3$] was used to allow complete relaxation of the nuclei.

Separation of gases was achieved on a gas chromatograph equipped with a gas injector and TC detector using oxidized Porapak Q ($\frac{1}{8}''\times 3'$) or 20% dimethylsulfolane on 80/100 chromosorb P ($\frac{1}{8}''\times 20'$; at −25° C.). GC/MS of gas samples were obtained on Finnigan 3300 (electron impact) using INCOS DATA system.

EXAMPLES 1–2

Treatment of Bitumen and Boscan Heavy Oil with Water.

Athabasca tar sand bitumen (substantially free of sand, supplied by Alberta Research Council) and Boscan heavy crude oil from Venezuela were used in Example 1 (Runs #1–5 and in Example 2 (Runs #6–9), respectively. The heavy oil and bitumen were treated in the continuous flow reactor described in the General Experimental. Most of the light hydrocarbon was separated from the condensed steam by a separatory funnel after allowing enough time for phase separation. The remaining light hydrocarbon and condensed steam were diluted with pentane and separated in a separatory funnel. Following drying over $MgSO_4$ and filtration, solvent was distilled off using a water bath at controlled temperature. The results of treatment of Boscan heavy crude oil and of tar sand bitumen with water at the various temperatures and various pressures are reported in Tables I, IIa and IIb and III, IVa and IVb, respectively.

TABLE I

Conversion of Boscan Heavy Oil into Light Hydrocarbons, Gas and Residue in a Continuous Flow Reactor

| Run | Te | P | O/W[2] | Products[3] | | |
|---|---|---|---|---|---|---|
| # | (°C.) | (psig) | (V/V) | LHC[4] | G[5] | R[6] |
| 1 | 460 | 500 | — | 70.7 | 2.5 | 26.8 |
| 2 | 450 | 500 | — | 68.3 | 2.8 | 28.9 |
| 3 | 430 | 500 | — | 72.3 | 2.5 | 25.2 |
| 4[a] | 400 | 750 | — | 50.4 | 2.0 | 47.6 |
| 5 | 450 | 250 | 0.7 | 73 | 3 | 24 |

Footnotes
[1]Temperatures reported are ±5° C.
[2]Oil:water ratio (volume/volume).
[3]Products in weight percent normalized to total of 100%; about 6 weight % products not recovered.
[4]Light hydrocarbons.
[5]Gases.
[6]Residue; percent conversion is calculated by formula: 100% - weight % residue recovered.
[a]Lower yield due to experimental difficulties with pressure seals.

TABLES IIa and IIb

Comparison of Properties of Boscan Heavy Oil, and the Light Hydrocarbons and Residue Obtained Therefrom by Treating Boscan Heavy Oil at Temperature of 450° C. and at a Pressure of 500 psig and 250 psig

TABLE IIa

| Property | Boscan Heavy Oil | Run #2 of Table I 500 psi/450° C.* Light HC | Residue |
|---|---|---|---|
| API Gravity | 10.3 | 28 | — |
| Viscosity, cp | 60,600 | 8.5 | — |
| (Temp) | (22° C.) | (25° C.) | |
| C wt % | 81.84 | 82.81 | |
| H | 10.41 | 11.49 | |
| N | 0.56 | 1400 | |
| S | 5.52 | 4.49 | |
| O | 1.25 | — | |
| H/C Ratio | 1.51 | 1.67 | |
| V wt ppm | 1500 | 0.9 | |
| Ni wt ppm | 100 | 2.2[a] | |
| Aromatic C % | 17.9 | —[b] | — |
| Pentane Soluble % | 78 | 100 | — |
| Toluene Soluble % | 100 | 100 | |

TABLE IIa-continued

| Property | Boscan Heavy Oil | Run #2 of Table I 500 psi/450° C.* Light HC | Residue |
|---|---|---|---|
| THF Soluble % | 100 | 100 | |

Footnotes to Table IIa
*yield data for Run #2 (wgt %): 67.6% Light HC; 1.8% Gas; 28.93% Residue.
[a]corrected valve; valve of 19 ppm of Ni was found in light HC; 16.8 of 19 ppm was due to nickel leached from new 55-300 nickel reactor.
[b] $^1$H nmr showed about 1.5 mole % unsaturation.

TABLE IIb

| Property | Boscan Heavy Oil | Run #5 of Table I 250 psi/450° C.** Light HC | Residue |
|---|---|---|---|
| API Gravity | 10.3 | 27.3 | — |
| Viscosity, cp | 60,600 | 10.7 | — |
| (Temp) | (22° C.) | | |
| C wt % | 81.84 | 82.80 | |
| H | 10.41 | 11.33 | |
| N | 0.56 | 1400 ppm | |
| S | 5.52 | 4.55 | |
| O | 1.25 | — | |
| H/C Ratio | 1.51 | 1.64 | |
| V wt ppm | 1500 | 0.9 | |
| Ni wt ppm | 100 | 2.[a] | |
| Aromatic C % | 17.9 | —[b] | — |
| Pentane Soluble % | 78 | 100 | — |
| Toluene Soluble % | 100 | 100 | |
| THF Soluble % | 100 | 100 | |

Footnotes to Table IIb
**yield data for Run #5 (wgt %): 73% Light HC; 3% Gas; 24% Residue
[a]Corrected value: value of 47 ppm Ni was found in light HC; 448 of 47 ppm Ni was due to nickel leached from new SS-300 nickel reaction.
[b] $^1$H nmr showed 1.5% unsaturation.

TABLE III

Conversion of Athabasca Tar Sand Bitumen into Light Hydrocarbons, Gas and Residue in the Continuous Flow Reactor of FIG. 1 at Various Temperatures and Pressures

| Run | T[1] | P | O/W[2] | Products[3] | | |
|---|---|---|---|---|---|---|
| # | (°C.) | (psig) | (V/V) | LHC[4] | G[5] | R[6] |
| 6 | 400 | 350 | 0.6 | 70 | 3 | 27 |
| 7 | 450 | 250 | — | 71.07 | 27.41 | 1.52 |
| 8 | 435 | 250 | — | 70.70 | 27.78 | 1.52 |
| 9 | 435 | 500 | — | 70.35 | 28.14 | 1.51 |

Footnotes to TABLE III
[1]Temperatures reported are ±5° C.
[2]Oil:Water ratio (volume/volume)
[3]Products reported as weight percent and normalized to 100%; about 6 weight % of products were not recovered
[4]Light Hydrocarbons
[5]Gases
[6]Residue

TABLE IVa

Comparison of Properties of Athabasca Tar Sand Bitumen, and of the Light Hydrocarbons and Residue Obtained Therefrom by Treatment with $H_2O$ at 435° and a Pressure of 250 psig in Continuous Flow Reactor of General Experimental.

| Property | Bitumen | Run #8 of Table III* 250 psig/435° C. Light HC | Residue |
|---|---|---|---|
| API Gravity (25° C.) | 10.0 | 25.2 | — |
| Viscosity (cp at 25° C.) | 72,500[a] | 13.4 | — |
| C wt % | 77.23 | 85.02 | 82.46 |
| H | 10.14 | 11.56 | 7.24 |
| N | 0.56 | 1100 ppm | 2.57 |
| S | 4.47 | 3.30 | 6.37 |
| Ash | 1.3 | — | 2.2 |
| H/C Ratio | 1.57 | 1.63[b] | 1.05 |
| V wt ppm | 240 | <.025 | 601 |
| Ni wt ppm | 76 | 3.3[c] | 187 |
| Pentane Soluble % | 72 | 72 | |

TABLE IVa-continued

Comparison of Properties of Athabasca Tar Sand Bitumen, and of the Light Hydrocarbons and Residue Obtained Therefrom by Treatment with $H_2O$ at 435° and a Pressure of 250 psig in Continuous Flow Reactor of General Experimental.

| Property | Bitumen | Run #8 of Table III* 250 psig/435° C. Light HC | Residue |
|---|---|---|---|
| Toluene Soluble % | 100 | 100 | |
| THF Soluble % | 100 | 100 | |

Footnotes to Table IVa

*yield data for Run #8 (wgt %): 79% Light HC; 7% Gas; 13% Residue

[a]Viscosity measured at 35° C.

[b] $^1H$ nmr showed about 1.5% unsaturation

[c]Corrected valve; a valve of 590 ppm of nickel was found in the light hydrocarbon; 586.7 pm of 590 ppm of Ni was due to nickel leached from new SS-300 nickel reactor.

TABLE IVb

Comparison of Properties of Athabasca Tar Sand Bitumen, and of Light Hydrocarbons and Residue Obtained therefrom by Treatment with $H_2O$ at 435° C. and a Pressure of 500 psig in the Continuous Flow Reactor of General Experimental

| Property | Tar Sand Bitumen | Run #9 of Table III 500 psig/435° C.[a] Light HC | Residue |
|---|---|---|---|
| API Gravity (25° C.) | 10.0 | 25.1 | — |
| Viscosity, cp | 72,500 | 14.1 | — |
| (Temp) | (35° C.) | (25° C.) | |
| C (wt %) | 77.23 | 85.01 | 82.26 |
| H (wt %) | 10.14 | 11.48 | 7.3 |
| N (wt %) | 0.56 | 1100 ppm | 1.62 |
| S (wt %) | 4.47 | 3.20 | 6.38 |
| Ash (wt %) | 1.3 | — | 2.0 |
| H/C Ratio | 1.57 | 1.62[b] | 1.07 |
| V (wt ppm) | 240 | <0.25 | 664 |
| Ni (wt ppm) | 76 | 3.2[c] | 217 |
| Pentane Soluble (%) | 72 | 100 | 60.5 |
| Toluene Soluble (%) | 100 | 100 | — |
| THF Soluble (%) | 100 | 100 | — |

[a]Yield Results (wt %): 7% Light HC; 1.0% Gas; 58.4% Residue

[b] $^1H$ nmr showed about 1.5% unsaturation

[c]Corrected valve; a value of 15 ppm of Ni was found in the light HC; 11.8 of the 15 ppm of Ni was due to nickel leached from 55-300 nickel reaction.

EXAMPLE 3

Athabasca tar sand bitumen (substantially free of sand and supplied by Alberta Research Council) was treated with water in the continuous flow reactor under steady state conditions described in the General Experimental in accordance with the procedure described in Example 1, except that only in Runs #6 and 17 were two dry ice trap inserted into the gas recovery line. The continuous unit steady state operation conditions and results (comparison of properties for treatment of Athabasca tar sand bitumen are reported in Tables V, VI,

TABLE V

Continuous Unit Operated under Steady State Conditions for Treatment of Athabasca Tar Sand Bitumen in a Continuous Flow Reactor

| Run # | Temp (°C.) | P (psig) | Run Time[a] (min) | % Conversion of Tar Sand Bitumen Avg Steady State[b] Conversion | Overall[c] Conversion |
|---|---|---|---|---|---|
| 10 | 435 | 500 | 161 | 68.4 | 63.5 |
| 11 | 435 | 500 | 211 | 70.0 | 65.8 |
| 12 | 435 | 500 | 211 | 74.2 | 69.9 |
| 13 | 433 | 500 | 164 | 75.0 | 70.5 |
| 14 | 435 | 250 | 184 | 69.5 | 68.4 |
| 15 | 435 | 500 | 180 | 74.3 | 72.2 |
| 16 | 458 | 500 | 150 | 77.0 | 72.0 |
| 17 | 435 | 750 | 180 | 64.5 | 62.0 |
| 18 | 435 | 100 | 180 | 77.0 | 75.0 |

Footnotes to Table V

[a]Time includes initial start-up period, steady state period and final transitional period; in the final transitional period the temperature was allowed to decrease and the tar sand bitumen was no longer fed (water flow remained constant throughout three periods).

[b]Average steady state % conversion of tar sand bitumen to light hydrocarbons and gaseous products was the average percent conversion calculated for that period of the total run time wherein unit operation conditions were relatively constant and wherein the % conversion to light hydrocarbon and gaseous products was maximized.

[c]Overall % conversion is the weighted average value of the % conversions of tar sand bitumen to light hydro-carbon and gaseous products over the total run time which is the sum of the initial start-up period, the steady state period and the final transitional period wherein tar sand bitumen feed has been stopped and the temperature allowed to decrease but wherein the water flow rate was maintained at its initial period.

TABLE VI

COMPARISON OF PROPERTIES OF ATHABASCA TAR SAND BITUMEN, THE LIGHT OILS AND RESIDUES PRODUCED IN A CONTINUOUS UNIT

| Property | Athabasca Bitumen | Run No. 10 Light Oil | Residue | Run No. 11 Light Oil | Residue | Run No. 12 Light Oil | Residue |
|---|---|---|---|---|---|---|---|
| API gravity 25° C. | 8.87 | 21.0 | −15 | 21.0 | −14.5 | 21.0 | −14.75 |
| Viscosity cp 25° C. | | 25.88 | — | 35.9 | — | 31.64 | — |
| Viscosity cp 60° C. | | 6.59 | — | 8.35 | — | 7.51 | — |
| C wt % | 82.77 | 83.74 | 82.56 | 83.72 | 80.17 | 83.61 | 80.81 |
| H | 10.17 | 11.19 | 7.22 | 11.01 | 7.42 | 10.92 | 6.78 |
| N | 0.37 | 0.12 | 0.90 | 0.13 | 0.89 | 0.15 | 1.07 |
| S | 4.91 | 3.73 | 6.14 | 3.85 | 5.94 | 3.81 | 6.16 |
| O | | | | | | | |
| Ash | | — | 0.73 | — | 2.8 | — | 2.8 |
| H/C ratio | 1.47 | 1.60 | 1.05 | 1.58 | 1.11 | 1.57 | 1.00 |
| V ppm (wt) | 181 | 1.6 | 642 | 0.9 | 708 | 1.0 | 688 |
| Ni ppm | 51 | 1.0 | 163 | 0.8 | 229 | 0.9 | 245 |
| Bromine No. | 81.28 | 84.16 | — | 85.47 | — | 81.28 | — |
| Aromatic C % | 23.9 | 23.1 | — | 22.6 | — | 23.3 | — |
| Aliphatic C % | 76.1 | 76.9 | — | 77.3 | — | 76.8 | — |
| Asphaltene | | | | | — | | |
| Water (%) | 0.67 | | | | — | | |
| Conradson Carbon | 12.7 | | | | — | | |
| Pyridine Sol % | | | | | 81.3 | | |

| Property | Run No. 13 Light Oil | Residue | Run No. 16 Light Oil | Residue | Run No. 17 Light Oil | Residue | Run No. 18 Light Oil | Residue |
|---|---|---|---|---|---|---|---|---|
| API gravity 25° C. | 22.5 | −15.0 | 22.7 | −15.1 | 24' | — | 18.4 | — |

TABLE VI-continued

COMPARISON OF PROPERTIES OF ATHABASCA TAR SAND BITUMEN, THE LIGHT OILS AND RESIDUES PRODUCED IN A CONTINUOUS UNIT

| | | | | | | | | |
|---|---|---|---|---|---|---|---|---|
| Viscosity cp 25° C. | 26.64 | — | 14.9 | — | 14.5 | — | 48.4 | — |
| Viscosity cp 60° C. | 6.43 | — | — | — | — | — | | |
| Viscosity cp 220° C. | | | — | 6000 | — | — | | |
| C wt % | 84.86 | 81.33 | 83.74 | 80.5 | — | — | | |
| H | 11.18 | 7.32 | 11.10 | 7.4 | — | — | | |
| N | 0.11 | 0.93 | 0.18 | 0.95 | — | — | | |
| S | 3.46 | 6.34 | 3.95 | 6.16 | — | — | | |
| O | | | 0.392 | 2.21 | — | — | | |
| Ash | — | 2.5 | — | 2.8 | — | — | | |
| H/C ratio | 1.58 | 1.08 | 1.58 | 1.103 | — | — | | |
| V ppm (wt) | 0.6 | 407 | 0.35 | 790 | 0.63 | — | 1.56 | — |
| Ni ppm | 1.5 | 106 | 1.00 | 230 | 0.44 | — | 1.84 | — |
| Bromine No. | 80.74 | — | 80.8 | — | — | — | | |
| Aromatic C % | 18.2 | — | | | | | | |
| Aliphatic C % | 81.8 | — | | | | | | |

Note:
(a) In run Nos. 1-7 about 2.5% light hydrocarbon products were lost. (Dry ice traps were not used).
(b) In run Nos. 10-18 about 2.5% (2.5% of based on feed, 4.0% of recover CHC) light hydrocarbon products were condensed in dry ice traps and analyzed separately.

TABLE VII

PROPERTIES OF THE LIGHT OIL AND DISTILLED FRACTIONS - RUN NO. 16

| Property | Total Liquid | 150-400° F. | 400°-500° F. | 550°-650° F. | 650°-850° F. | 850°-979° F. | Residue +979° F. |
|---|---|---|---|---|---|---|---|
| Yield wt % of feed | 77.02* | 6.65 | 8.32 | 15.11 | 20.53 | 17.34 | 6.57 |
| Sp. Gravity at 25° C. | 0.918 | 0.7658 | 0.8693 | 0.9106 | 0.9445 | 1.0501 | — |
| Viscosity at 25° C. | 14.9 | 0.65 | 2.47 | 7.91 | 53.5 | 842.1 | |
| Refri. Index at 25° C. | 1.513 | 1.4335 | 1.4809 | 1.5045 | 1.5281 | 1.5454 | |
| Sulfur wt % | 3.95 | 2.42 | 3.38 | 3.78 | 4.12 | 4.21 | 4.64 |
| Nitrogen wt % | 0.18 | 0.03 | 0.03 | 0.07 | 0.15 | 0.23 | 0.30 |
| V ppm wt % | 0.35 | <0.1 | <0.1 | <0.1 | <0.1 | <0.1 | 2.3 |
| Ni ppm wt % | 1.00 | 0.5 | 0.7 | 0.4 | 0.6 | 0.6 | 7.5 |
| Conradson Carbon | — | — | — | — | — | — | 8.13 |

*in addition, 2.5 weight % of the feed was collected in a dry ice tray and was presumably $C_5$-$C_7$. This condensate fraction was not analyzed.

COMPARATIVE EXAMPLE 4

This example illustrates treatment of Boscan heavy crude oil with water in an apparatus similar to that disclosed in U.S. Pat. No. 2,135,332 (Gary), but at the higher pressures of our U.S. Pat. No. 4,446,012. The apparatus and procedure of FIG. 3 of U.S. Pat. No. 4,446,012 were used with the modification detailed herein below to provide for reduction of temperature and pressure to ambient before separation of residue from reaction mixture from which light hydrocarbon product is obtained.

In a typical experiment, Boscan heavy oil and water were pumped into a tubular reactor. The oil/$H_2O$ ratio and pump rate were varied. The tubular reactor 51 was heated to about ~465°-470° C. in a fluidized sand bath. The mixture product formed was directly transferred from tubular reactor 31 to a condensing flask 77 via line 69 through pressure control valve 75. Condensed oil and $H_2O$ were worked up in two steps: first, water was distilled off in vacuum. Second, the oil obtained was distilled according to ASTM type distillation methods. The results for a series of experiments wherein residence time in tubular heater 51 of FIG. 3 of U.S. Pat. No. 4,446,012 was varied are summarized in Table VIII.

TABLE VIII

Conversion of Boscan Heavy Oil at 465° C.-470° C. and 2000 psi in a Continuous Flow Tubular Reactor 51 of FIG. 3 of U.S. Pat. No. 4,446,012

| Residence Time Min, Sec. | Light Oil[a] wt % | Gas wt % |
|---|---|---|
| 6, 35[b] | 76 | 1.25 |
| 1, 40[c] | 53.5 | 1.00 |
| 1, 15 | 49.6 | 0.8 |
| 0, 30 | 44.9 | 0.6 |
| Virgin Boscan | 37.7[d] | — |

[a]Processed oil distilled after temperature and pressure letdown to ambient according to ASTM type method. Max. pot temp. 325° C., heating rate 2° C./min. Max distillate temperature 225° C., Vac. 0.1 mm.
[b]At 6 min. 35 sec. residence time all the residue which might have been coke stayed in the coil. Plugging occurred. Reaction was terminated after 100 g of Boscan heavy oil was fed to tubular reactor 51 (reactor volume equal to 73 g of oil).
[c]Slow build-up of coke formation in the tubular reactor.
[d]Vacuum distillate.

Two other experiments were run in the continuous flow tubular reactor 51 of FIG. 3 of U.S. Pat. No. 4,446,012 under identical conditions to those detailed above, except that the pressure was 2500 and 3500 psi, respectively. In both experiments, coke formation occurred thereby clogging the tubular reactor and the reaction was terminated after 100 g of Boscan heavy crude oil had been fed to tubular reactor 51. It is believed that similar results would be obtained if such comparative runs were run in the continuous fashion and lower pressures of the present application, at steady state (if attainable).

EXAMPLE 5

Treatment of Residue

Residue from runs 12, 14 and 17 was further treated using the batch reactor of FIG. 3 of U.S. Pat. No. 4,446,012. The residue from a single run was charged at about 200° C. into a preheated (about 450° C.) autoclave purged with nitrogen gas. The material was allowed to heat to 410° C. in 5 minutes. During the heating period, about 20 ml of water was added to develop pressure. Once 1500 psig (10,200 kPa) of pressure and 410° C. were attained, compressed steam at 410° C. was passed at 10 ml/min flow rate into the autoclave, with pressure maintained by manually controlling a let-down valve. A total of 2000 ml of water was used for the reaction.

The extract and condensed steam were collected in a three-neck flask. Most of the light oil was separated from the condensed steam by a separatory funnel after phase separation. The remaining light oil and condensed steam were diluted with pentane and separated in a separatory funnel. Following drying over magnesium sulfate and filtration, solvent was distilled off using a water bath at controlled temperature under pressure. The material left in the autoclave was considered unconverted residue. The results were as follows:

| Residue from Run | API of Liquid | Yield (wt %) Liquid | Yield (wt %) Gas | Unconverted Residue |
|---|---|---|---|---|
| 12 | 19.6 | 33.3 | 8.5 | 58.2 |
| 14 | 19.0 | 36.9 | 3.9 | 59.2 |
| 17 | 20 | 35.8 | 4.4 | 59.8 |

It is expected that the residue from any of the continuous runs could also be treated by continuous reaction at the about 100 psig (690 kPa) to less than about 725 psig (5,000 kPa) pressure and about 400°–480° C. temperature of the present application and yield significant additional liquid and gas beyond that produced in the first stage.

We claim:

1. A process for converting heavy hydrocarbons into light hydrocarbons which comprises:

(a) contacting, in a first zone, heavy hydrocarbons having an API gravity at 25° C. of less than about 20 with a liquid comprising water, in the absence of externally added catalyst and hydrogen, at a temperature between about 400° C. and about 480° C. and at a pressure between about 690 kPa (about 100 psig, about 6.76 atm) and less than about 5,000 kPa (about 725 psig, about 49 atm), and for a contact time under continuous flow conditions sufficient to form a uniform mixture;

(b) forwarding the uniform mixture to a second zone while maintaining the temperature and pressure conditions of the first zone;

(c) maintaining the uniform mixture in the second zone at substantially steady state conditions under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water and light hydrocarbon product having an API gravity at 25° C. of greater than about 20 and substantially free of vanadium and nickel values; and (f) recovering said light hydrocarbon product.

2. The process of claim 1 wherein the temperature of the first and second zones is between about 420° and about 470° C.

3. The process of claim 1 wherein the pressure of the first and second zones is between about 1725 kPa (about 250 psig, about 16.9 atm) and less than about 5,000 kPa (about 725 psig, about 49 atm).

4. The process of claim 1 wherein the residue withdrawn from the second zone is contacted in a third zone with a fluid comprising water at substantially the temperature and pressure of the first and second zones to form a second phase comprising water and additional light hydrocarbon products and a second residue, and wherein the second phase and the second residue are withdrawn from the third zone.

5. The process of claim 1 wherein the light hydrocarbon product has a total vanadium and nickel content of less than about 5 ppm.

6. The process of claim 1 wherein in step (e) said phase is separated by reducing the pressure and temperature to values sufficient to allow separation of said phase into the gaseous product, the liquid comprising water and said light hydrocarbon product.

7. A process for converting heavy hydrocarbons into light hydrocarbons which comprises:

(a) contacting, in a first zone, heavy hydrocarbons having an API gravity at 25° C. of less than about 20 and a total vanadium and nickel content between about 1000 and 2000 ppm with a liquid comprising water, in the absence of externally added catalyst and hydrogen, at a temperature between about 400° C. and about 480° C., and at a pressure about 690 kPa (about 100 psig, about 6.76 atm) and less than about 5,000 kPa (about 725 psig, about 49 atm) for a contact time under continuous flow conditions sufficient to form a uniform mixture;

(b) forwarding the uniform mixture to a second zone while maintaining the temperature and pressure conditions of the first zone;

(c) maintaining the uniform mixture in the second zone at substantially steady state conditions under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and a light hydrocarbon product having an API gravity at 25° C. of between about 20 and 40 and substantially free of vanadium and nickel values; and (f) recovering said light hydrocarbon product.

8. The process of claim 7 wherein the temperature of the first and second zones is between about 420° and 470° C.

9. The process of claim 7 wherein the pressure of the first and second zones is between about 1,725 kPa (about 250 psig, about 16.9 atm) and less than about 5,000 kPa (about 723 psig, about 49 atm).

10. The process of claim 7 wherein the heavy hydrocarbons have a viscosity at 25° C. of at least about 60,000 cp and the light hydrocarbon product has a viscosity at 25° C. less than about 10 cp.

11. The process of claim 17 wherein the light hydrocarbon product has a total vanadium and nickel content of less than about 5 ppm.

12. The process of claim 17 wherein the gaseous product is less than 10 percent by weight of the heavy hydrocarbon stream.

13. The process of claim 7 wherein in step (e) said phase is separated by reducing the pressure and temperature to values sufficient to allow separation of said phase into the gaseous product, the liquid comprising water and said light hydrocarbon product.

14. A process for converting heavy hydrocarbons into light hydrocarbons which comprises:

(a) contacting, in a first zone, heavy hydrocarbons having an API gravity at 25° C. of less than about 20 and a total vanadium and nickel content of between about 100 and 1000 ppm with a liquid comprising water, in the absence of externally added catalyst and hydrogen, at a temperature between about 400° and 480° C. and at a pressure between about 690 kPa (about 100 psig, about 6.76 atm) and less than about 5,000 kPa (about 725 psig, about 49 atm) for a contact time under continuous flow conditions sufficient to produce a uniform mixture;

(b) forwarding the uniform mixture to a second zone while maintaining the temperature and pressure conditions of the first zone;

(c) maintaining the uniform mixture in the second zone at substantially steady state under the temperature and pressure conditions of the first zone, in the absence of externally added catalyst and hydrogen, for a time sufficient to separate the uniform mixture into a residue and a phase comprising light hydrocarbons, gas and water;

(d) withdrawing the residue and said phase from the second zone;

(e) separating said phase into a gaseous product, a liquid comprising water, and a light hydrocarbon product having an API gravity at 25° C. of between about 20 and 40 and substantially free of vanadium and nickel values; and (f) recovering said light hydrocarbon product.

15. The process of claim 14 wherein the temperature of the first and second zones is between about 420° and 470° C.

16. The process of claim 14 wherein the pressure of the first and second zones is between about 1725 kPa (about 250 psig, about 16.9 atm) and less than about 5,000 kPa (about 725 psig, about 49 atm).

17. The process of claim 14 wherein the heavy hydrocarbons have a viscosity at 25° C. of at least about 30,000 cp and the light hydrocarbon product has a viscosity at 25° C. less than about 10 cp.

18. The process of claim 14 wherein the light hydrocarbon stream has a total vanadium and nickel content less than about 10 ppm.

19. The process of claim 14 wherein the light hydrocarbon stream has a total vanadium and nickel content of less than about 5 ppm.

20. The process of claim 14 wherein the gaseous stream is less than 10 percent by weight of the heavy hydrocarbon stream.

21. The process of claim 18 wherein in step (e) said phase is separated by reducing the pressure and temperature to values sufficient to allow separation of said phase into the gaseous product, the liquid comprising water and said light hydrocarbon product.

22. The process of claim 7 wherein the residue withdrawn from the second zone is contacted in a third zone with a fluid comprising water at substantially the temperature and pressure of the first and second zones to form a second phase comprising water and additional light hydrocarbon products and a second residue, and wherein the second phase and the second residue are withdrawn from the third zone.

23. The process of claim 14 wherein the residue withdrawn from the second zone is contacted in a third zone with a fluid comprising water at substantially the temperature and pressure of the first and second zones to form a second phase comprising water and additional light hydrocarbon products and a second residue and wherein the second phase and the second residue are withdrawn from the third zone.

* * * * *